US007686091B2

(12) United States Patent
Jennings et al.

(10) Patent No.: US 7,686,091 B2
(45) Date of Patent: Mar. 30, 2010

(54) DEVICE TO INSERT A FLEXIBLE MEMBER INTO PRESSURIZED WELLHEAD HOUSING

(75) Inventors: Charles E. Jennings, Tomball, TX (US); Johnny Jurena, Houston, TX (US); David D. Comeaux, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 94 days.

(21) Appl. No.: 12/181,015

(22) Filed: Jul. 28, 2008

(65) Prior Publication Data

US 2010/0018721 A1 Jan. 28, 2010

(51) Int. Cl.
*E21B 19/08* (2006.01)
*E21B 19/22* (2006.01)

(52) U.S. Cl. ..... 166/385; 166/77.1; 166/77.3; 226/172; 226/173

(58) Field of Classification Search ..... 166/385, 166/77.1, 77.3; 226/172, 173
See application file for complete search history.

(56) References Cited

U.S. PATENT DOCUMENTS

| | | | |
|---|---|---|---|
| 5,927,405 | A | 7/1999 | Monjure et al. |
| 6,186,239 | B1 | 2/2001 | Monjure et al. |
| 7,044,227 | B2 | 5/2006 | Jennings et al. |
| 7,069,995 | B2 | 7/2006 | Chan et al. |
| 2003/0106693 | A1 | 6/2003 | Jennings et al. |

OTHER PUBLICATIONS

U.S. Appl. No. 12/167,979, filed Jul. 3, 2008, Titled "Acoustically Measuring Annulus Probe Depth".

*Primary Examiner*—Giovanna C Wright
(74) *Attorney, Agent, or Firm*—Bracewell & Giuliani

(57) ABSTRACT

A drive assembly for inserting hose within a wellhead housing that intermittently reciprocates the hose feed into the housing. The intermittent reciprocating action feeds the hose past obstacles in the wellhead housing, such as within annuluses between tubulars. The drive assembly includes rollers that frictionally contact the hose and when rotated drive the hose forward. The rollers are rotated by a drive sprocket that is rotated by a hand crank. An offset cam assembly between the hand crank and the drive sprocket adds an orbital/reciprocating motion to the drive assembly.

15 Claims, 9 Drawing Sheets

DEVICE TO INSERT A FLEXIBLE MEMBER INTO PRESSURIZED WELLHEAD HOUSING

BACKGROUND

1. Field of Invention

The device described herein relates generally to the production of oil and gas. More specifically, the present disclosure relates to a system and method for inserting a flexible member into a wellhead housing. The disclosure further relates to feeding a hose into a casing annulus.

2. Description of Related Art

Hydrocarbon producing wellbores have casing lining the wellbore and production tubing suspended within the casing. Some wellbores may employ multiple well casings of different diameters concentrically arranged in the wellbore. In some instances, a casing string may develop a leak, thereby pressurizing an annulus between the leaking casing string and adjacent casing. Other sources of leaks include tubing, packers, wellhead packoffs, and faulty casing cement bond.

Pressure in the annulus can be controlled by introducing a high specific gravity fluid into the annulus, thereby isolating the wellhead from the pressure. In addition to adding fluid directly to the top of the annulus through a wellhead, hydraulic hose systems have been used to inject fluid into the pressurized annulus. The hose generally includes a nozzle element lowered proximate to the annulus bottom where the fluid is discharged from the hose. Typically the hose is stored on a reel from which it is unrolled, and then inserted through an entry in the wellhead. Although the hose may be stiffened with internal pressure, it may still bend when forced through the labyrinth of turns encountered between the wellhead and annulus.

SUMMARY OF INVENTION

A method and system is disclosed herein useful for inserting a flexible member into a wellhead assembly. The system may include a drive assembly having a drive roller for frictionally engaging and advancing the flexible member into the wellhead assembly, wherein the drive assembly and drive roller are laterally moveable is a direction generally parallel to the flexible member. The system also includes a rotatable drive shaft having an axis offset from an axis of the drive roller, and a coupling member for connecting the drive shaft to the drive roller. The coupling member rotating the drive roller about its axis in response to drive shaft rotation, due to the drive shaft axis and drive roller axis offset, the coupling member laterally reciprocating moves the drive assembly in forward and rearward directions about the drive shaft. The system may be included with a casing annulus remediation system as well as an inspection system.

The method includes feeding a flexible member into a wellhead assembly using a drive assembly, where the drive assembly automatically reciprocates the flexible member in a back and forth rotation and an intermittent back and forth longitudinal direction. Reciprocating the flexible member allows it to avoid obstacles in the wellhead assembly.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
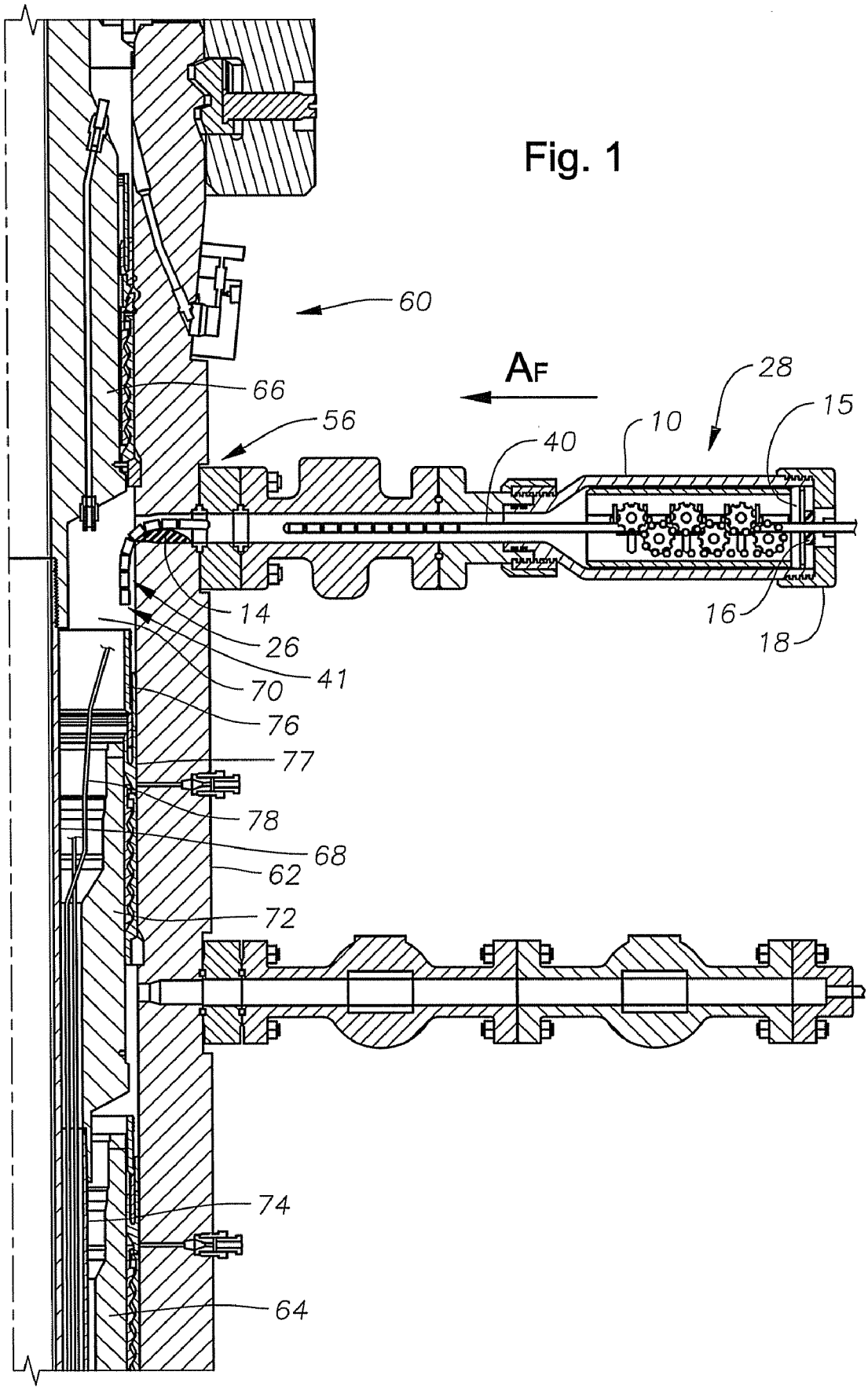
FIG. 1 is a side sectional view depicting a drive roller assembly coupled to a wellhead housing.

The device and method described herein can prevent an elongated flexible member from becoming jammed within a wellhead assembly when deploying the flexible member into the wellhead assembly and when advancing the member within the wellhead assembly. Flexible members can include items such as a hose, a wire, tubing, or any other item inserted into a wellhead assembly. FIG. 1 is a side partial sectional view of a wellhead assembly 60, having a drive roller assembly 28 attached on its outer housing. The wellhead assembly 60 is affixed over a wellbore and comprises an outer housing 62 having a length of conductor pipe (not shown) extending from its bottom end into the wellbore. A first casing hanger 64 is coaxially affixed within the lower portion, of the housing 62, and a second casing hanger 72 is also coaxially inserted therein and above the first casing hanger 64. Casing 74 is illustrated as attached on its upper end to a lower portion of the second casing hanger 72. A tubing hanger 66 is mounted within housing 62 and attached coaxially within the housing 62 above the second casing hanger 72. Attached to the lower end of the tubing hanger 66 is tubing 68 that extends coaxially within the casing 74.

The drive roller assembly 28 advances a flexible member 40 from within the assembly 28 and through the wellhead assembly 60 housing. Seals 16 may optionally be provided on the bulkhead 15 just inside of an endcap 18 on the rearward end of the housing 10. The seals 16 may provide a pressure seal along the flexible member 40. The flexible member 40 passes through a wellhead axis port 56 formed through the wellhead assembly 60 housing. After passing through the wellhead access port 56, the flexible member 40 enters an annulus 70 formed within the wellhead assembly 60. The annulus 70 is defined between a portion of the housing 62 inner circumference and the tubing hanger 66 outer surface. The annulus 70 extends over within the wellhead assembly 60 past the lower terminal end of the tubing hanger 66 and along the tubing 68 outer surface. An energizing ring 76 combined with a seal 77 is illustrated disposed just below the tubing hanger 66 lower terminal end and having a lower end that radially circumscribes the second casing hanger 72 upper terminal end. The annulus 70 outer circumference is bounded by the energizing ring 76 and seal 77 inner surface, the second casing hanger 72 inner circumference, and the casing 74 inner circumference. Illustrating a potential path for the flexible member 40 within the wellhead housing 60 is a line 78 within the annulus 70 provided from its upper end to below the second casing hanger 72.

Hardware along the annulus 70 periphery can obstruct the passage of a flexible member 40 through the annulus 70. For example, the upper terminal end of the energizing ring 76 has a planar upper surface where the flexible member 40 lower end 41 can land. Additionally, a space exists between the energizing ring 76 outer circumference and the housing 62 inner surface where the lower end 41 can become wedged during member 40 deployment. Other obstacles include the profiled upper portion of the second casing hanger 72 as well as the upper casing hanger 72 upper terminal surface. As will be described in more detail below, the roller drive assembly 28 combines advancing or feeding the flexible member 40 into the wellhead assembly 60 and annulus 70 with an intermittent reciprocating or pecking motion. The drive roller assembly 28 automatically imparts a forward and aft motion to the flexible member 40; when the lower end 41 contacts a potential obstacle the intermittent and automatic reciprocating action draws the lower end 41 away from the object and follows with an advancing motion to cast the lower end 41 past the obstacle. The reciprocating/pecking motion is not limited to downward applications, but can guide the lower end 41 past obstacles when the flexible member 40 is being advanced horizontal or even upward.

Figure 2:
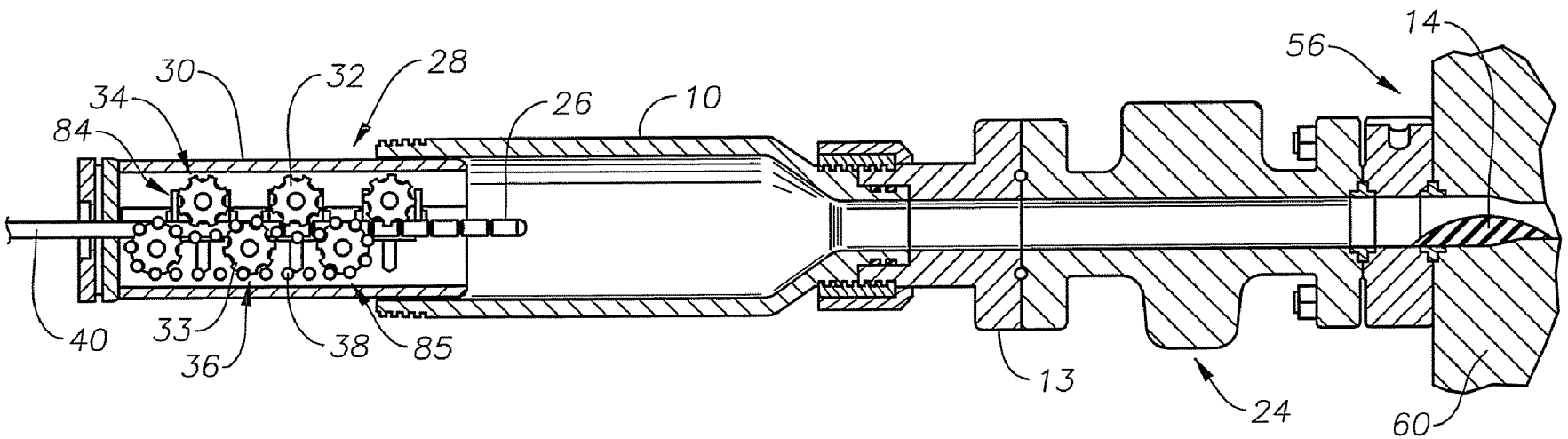
FIG. 2 is a side sectional view of the roller assembly of FIG. 1 being inserted into a housing and valve assembly.

With reference now to FIG. 2 a side partial sectional view of the drive roller assembly 28 is illustrated, wherein the assembly 28 is shown being inserted into a pressure containment housing 10. The pressure containment housing 10 is threadingly connected on one end to a flange connection 13, where the flange connection 13 is bolted to a gate valve assembly 24. The gate valve assembly 24 is bolted to the wellhead assembly 60 and in communication with the wellhead axis port 56. An optional polymeric insert 14 is inserted within the access port 56 for protecting the flexible member 40 while it is being advanced into the wellhead assembly 60. Preferably, the gate valve 24 is first bolted to the wellhead assembly 60, then the flange 13 is bolted to the gate valve 24, the housing 10 is then coupled to the flange 13, and then the assembly 28 is inserted into the housing 10.

The drive roller assembly 28 is shown having a series of rollers, wherein each roller is coaxially connected with an associated sprocket. A slide frame 30 provides structural support and housing for the drive roller assembly 28. More specifically, the embodiment of the drive roller assembly 28 illustrated in FIG. 2 comprises rollers, wherein the roller axes are oriented generally parallel and the rollers are aligned in the same plane. In the embodiment illustrated, an upper series of rollers 84 is aligned laterally so each roller is at roughly the same elevation. A second or lower series of rollers 85 is included that is also aligned with each roller at generally the same elevation. The second series of rollers 85 is disposed just below the upper series of rollers 84. A flexible member 40 is shown between the upper and lower series of rollers (84, 85).

Figure 10:
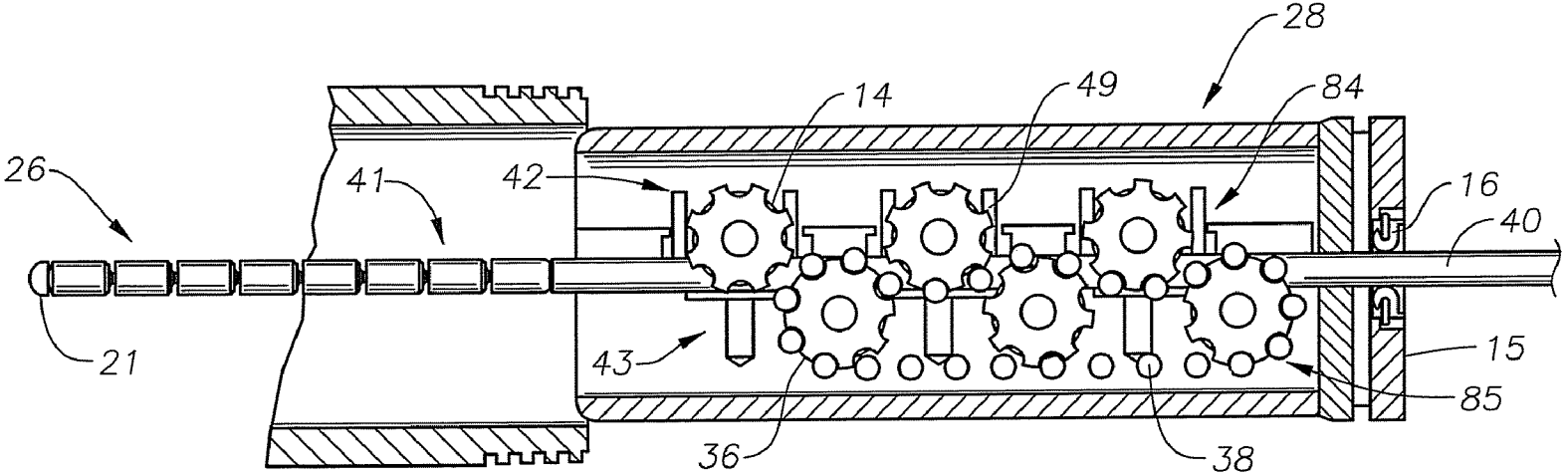
FIG. 10 is a side view of a roller assembly of FIG. 1 in a closed position.

A drive roller 36 is included within the lower series of rollers 85 and affixed to a drive sprocket 33. The drive sprocket 33 is attachable to a drive means for rotating the drive sprocket 33. A belt chain 38 mechanically couples the remaining sprockets on the lower series of rollers 85. As shown in FIG. 10 and described below, when the drive assembly 28 is in a closed position, the sprockets on the upper series of rollers 84 are also in engaging contact with the belt chain 38, thereby mechanically coupling all sprockets within the assembly 28. Accordingly, rotating the drive sprocket 33, when the assembly 28 is in its closed position rotates all of the sprockets and their associated rollers.

Figure 4:
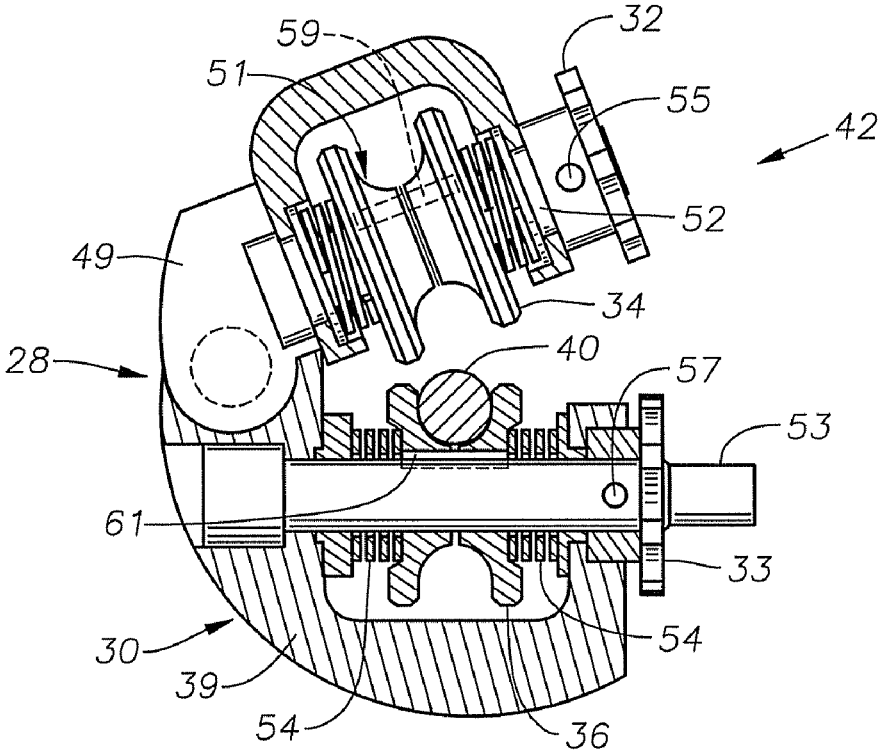
FIG. 4 is an axial view of an embodiment of the drive roller assembly of FIG. 1 in an open position.

FIG. 4 depicts an axial or end view of a drive roller assembly 28 illustrated in its open position, the drive roller assembly 28 having a slide frame 30 having a lower section 39 hingedly affixed to an upper section 49. The lower section 39 includes a drive pin 53 rotatingly mounted in the lower section 39 transverse to the elongated axis of the drive roller assembly 28. Coaxially mounted on the drive pin 53 is a drive sprocket 33 disposed adjacent the lateral terminal side of the lower section 39. A bore 57 is formed through the drive pin 53 and the drive sprocket 33 in which a pin (not shown) may be inserted for affixing the sprocket 33 to the drive pin 53. Also coaxially mounted on the drive pin 53 is the drive roller 36 disposed proximate to the drive pin 53 mid section and within the frame 30. Springs 54 are coaxially inserted over the drive pin 53 and combine to exert an axial force onto the drive roller 36 from its opposite sides. A key 61 is disposed in registered recesses correspondedly formed on the outer surface of the drive pin 53 along its axis and coaxially within the drive roller 36 along its contact surface 37. Thus, through coupling with the drive pin 53, the drive roller 36 rotates in response to drive sprocket 33 rotation. The upper section 49 also includes a drive pin 52 affixed to an upper drive sprocket 32 with a pin (not shown) inserted in a bore 55, where the bore 55 extends through the drive pin 52 and the upper drive sprocket 32. A roller 51 is coaxially secured onto the drive pin 52 with a key 59 disposed in registered recesses (as described above), springs 54 are provided on its outer lateral sides on the drive pin 52.

Figure 7:
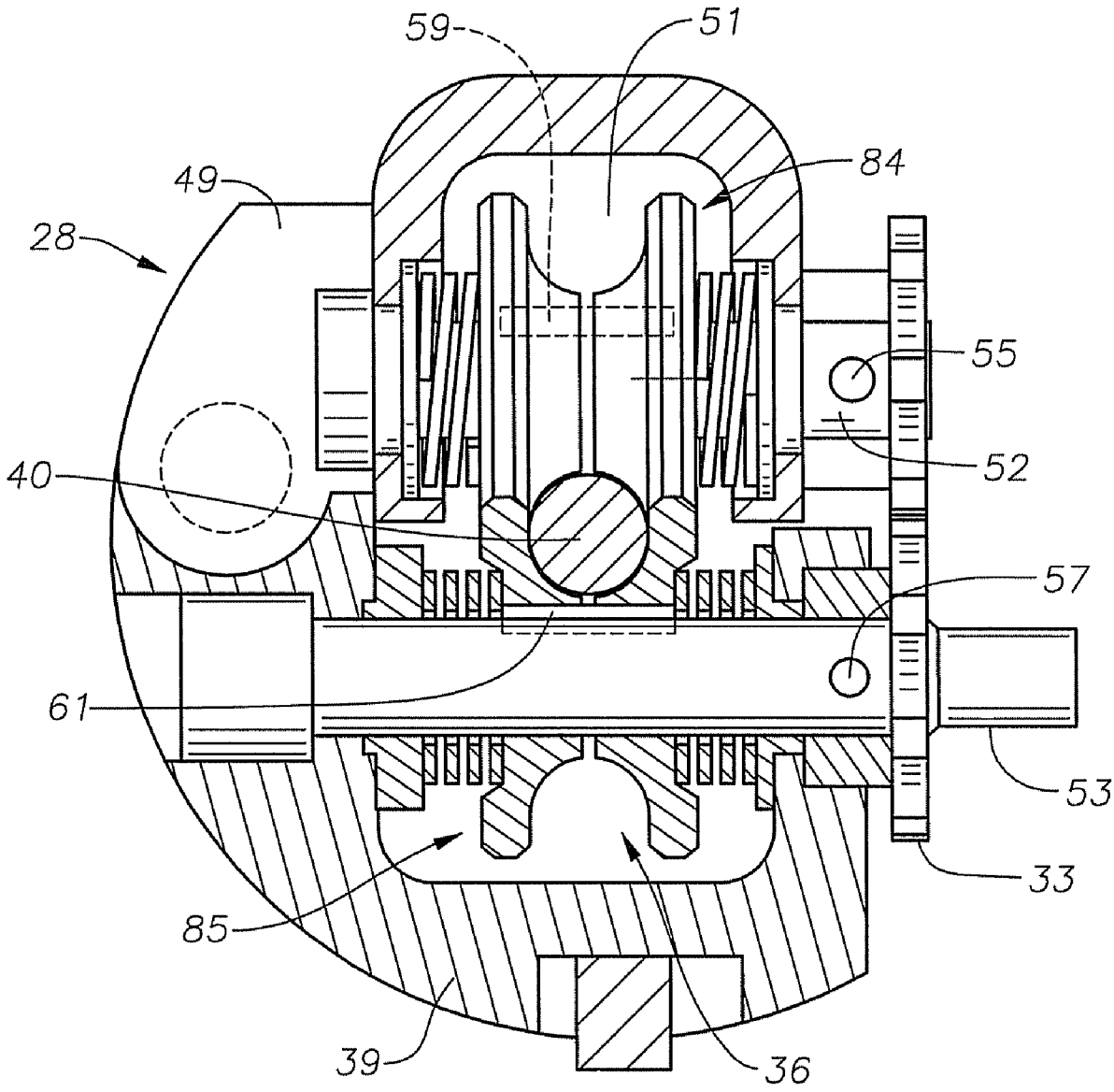
FIG. 7 is an axial view of the drive roller assembly of FIG. 4 in a closed position.
Figure 8:
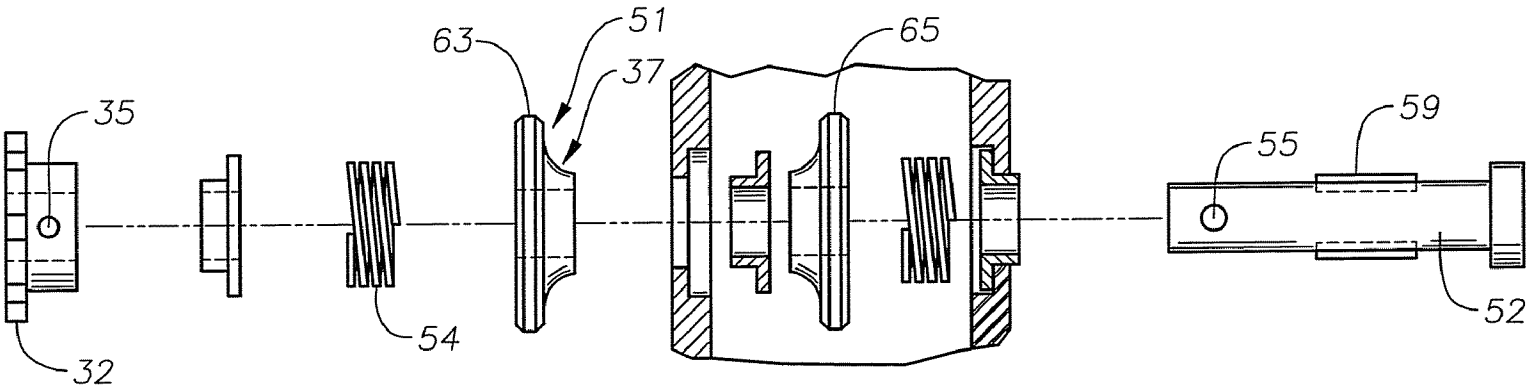
FIG. 8 is a side exploded view of a portion of a drive roller assembly of FIG. 1.

FIG. 7 illustrates an axial view of an embodiment of the drive roller assembly 28 in a closed position, wherein the upper section 49 is hinged downward into engagement with the lower section 39. Closing the upper section 49 onto the lower section 39 compressively engages the flexible member 40 between the upper series 84 and the lower series 85 (FIG. 2). In the embodiment of FIG. 7, the drive roller 36 is in the lower series 85 and the roller 51 is in the upper series 84. FIG. 8 depicts an exploded view of the drive pin 52, roller 51, and sprocket 32 and illustrates that optionally two keys 59 may be included between the drive pin 52 and the roller 51. Also illustrated in FIG. 8 is that the roller 51 may optionally comprise a first half 63 and a second half 65. Each half 63, 65 comprises an annular member coaxially disposed on the drive pin 52 having a first inner end that are oppositely disposed and can contact one another when pushed together by the springs 54. On the opposite end of each half 63, 65 is a disk-like flange forming the lateral end of each half 63, 65. Each half 63, 65 has an outer diameter that exponentially increases, in opposite directions, from the inner end to the flange; the outer diameter defines the roller contact surface 37. The contact surface 37 profile is contoured to frictionally engage the flexible member 40. Additionally, the option of providing a roller with a first half 63 and a second half 65 enables a roller to engage flexible members of more than one diameter by being spread apart when engaging the member 40. Depending on the flexible member 40 dimensions, the halves 63, 65 may be urged outwardly away from each other and against the spring 54. The spring force provides a responsive force to retain engagement of the halves 63, 65 with the flexible member 40 for a continuous frictional engagement with the member 40.

Figure 5:
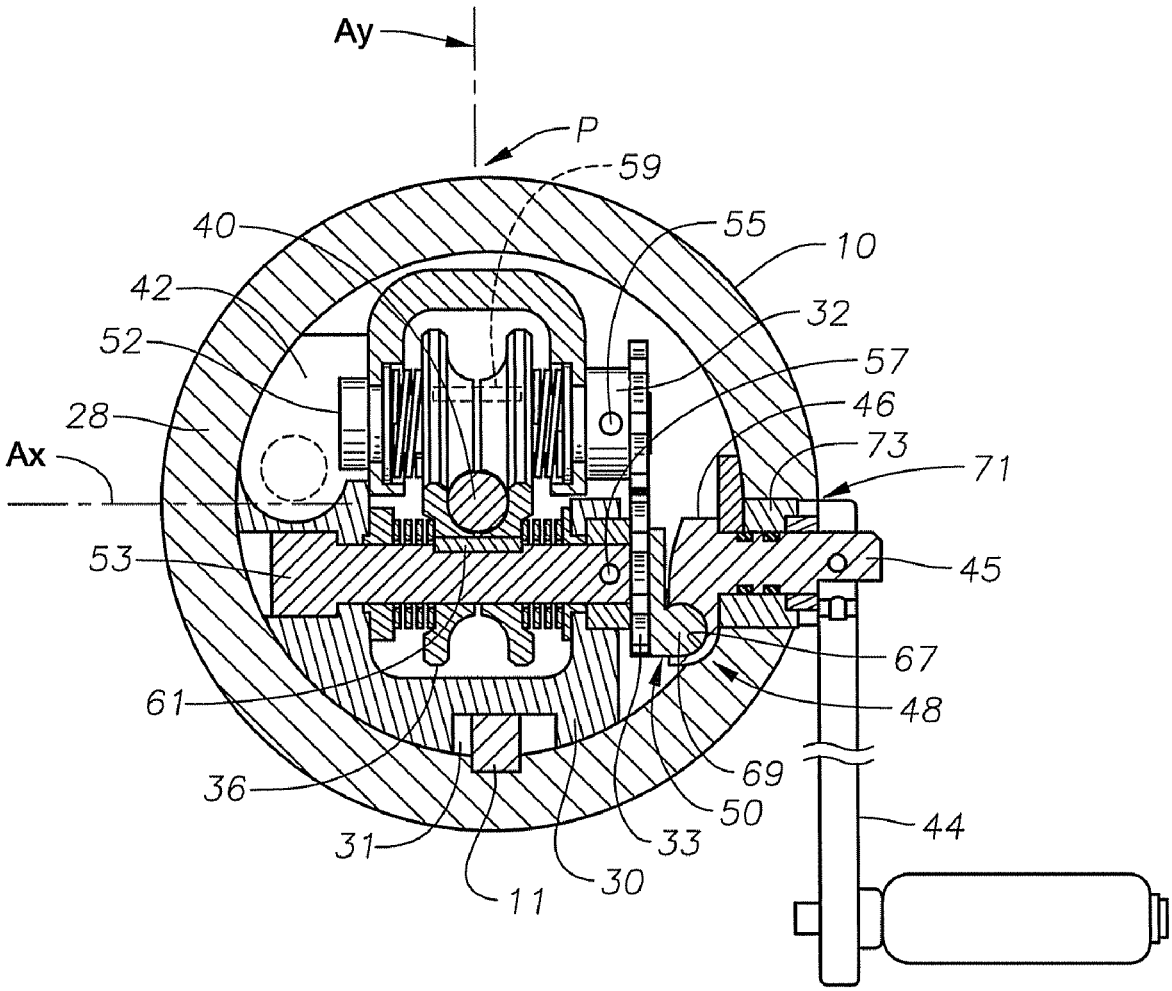
FIG. 5 axially depicts the drive roller assembly of FIG. 4 in the closed position disposed in a housing.

FIG. 5 illustrates an axial view of the drive roller assembly 28 of FIG. 7 inserted within the pressure containment housing 10. Further included, is a hand crank 44 mechanically coupled to the drive sprocket 33 of the drive assembly 28. The hand crank 44 is affixed to a drive shaft 45, which extends through the pressure containment housing 10 adjacent the drive assembly 28. The drive shaft 45 is an elongated member and oriented generally parallel with the horizontal axis $A_X$ of the pressure containment housing 10. Alternatively, the drive shaft 45 could be rotated by other drive means, such as a motor.

A female cam 46 is provided on the end of the drive shaft 45 within the pressure containment housing 10. The female cam 46 extends laterally away from the drive shaft 45 end. A male cam 50 is joined to the female cam 46 by a coupling 48. The male and female cams 46, 50 serve as linking arms coupling the drive shaft 45 and the drive pin 53. In the embodiment illustrated, the coupling 48 comprises a socket 67 in the free end of the female cam 46 formed to receive a ball 69 provided on the coupling end of the male cam 50. However, the coupling 48 may comprise any configuration that mechanically joins the male and female cams 50, 46 and allows rotation between the two cam members 50, 46. The end of the male cam 50 not coupled with the female cam 48 is affixed to the end of the drive pin 53 proximate to the drive sprocket 33. Actuating the hand crank 44 rotates the drive shaft 45 and female cam 46, which in turn rotates the male cam 50 and the drive sprocket 33.

Figure 9:
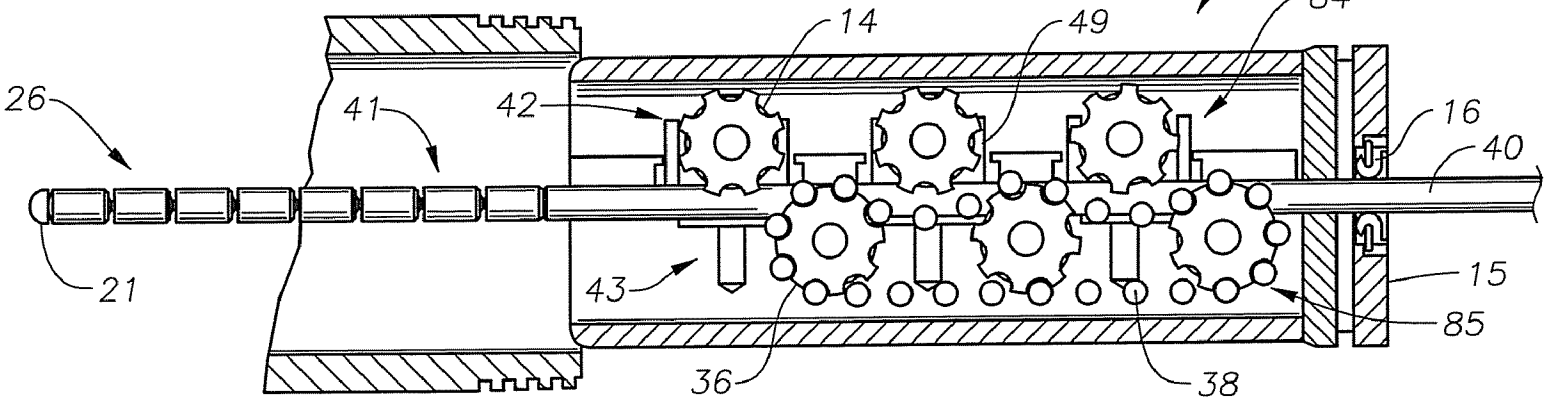
FIG. 9 is a side view of a roller assembly of FIG. 1 in an open position.

FIGS. 9 and 10 are side partial sectional views respectively illustrating the drive roller assembly 28 in an open and a closed position. With reference now to FIG. 9, the flexible member 40 is illustrated extending between upper series of rollers 84 with associated sprockets on the upper section 49 and lower series of rollers 85 with associated sprockets on the lower section 39. The upper section 49 is hinged upward in the FIG. 9 embodiment thus the upper series of rollers 84 are not in engaging contact with the flexible member 40. FIG. 10 illustrates the upper section 49 hinged downward into the closed position with the upper series of rollers 84 in engaging contact with the flexible member 40. Additionally, when in the closed position the sprockets associated with the upper series of rollers 84 are in engagement with the drive belt 38. Accordingly, when the drive roller assembly 28 is in the closed position, rotating any one of the sprockets rotates all other sprockets on the drive assembly 28 thus rotating all rollers.

Figure 6A:
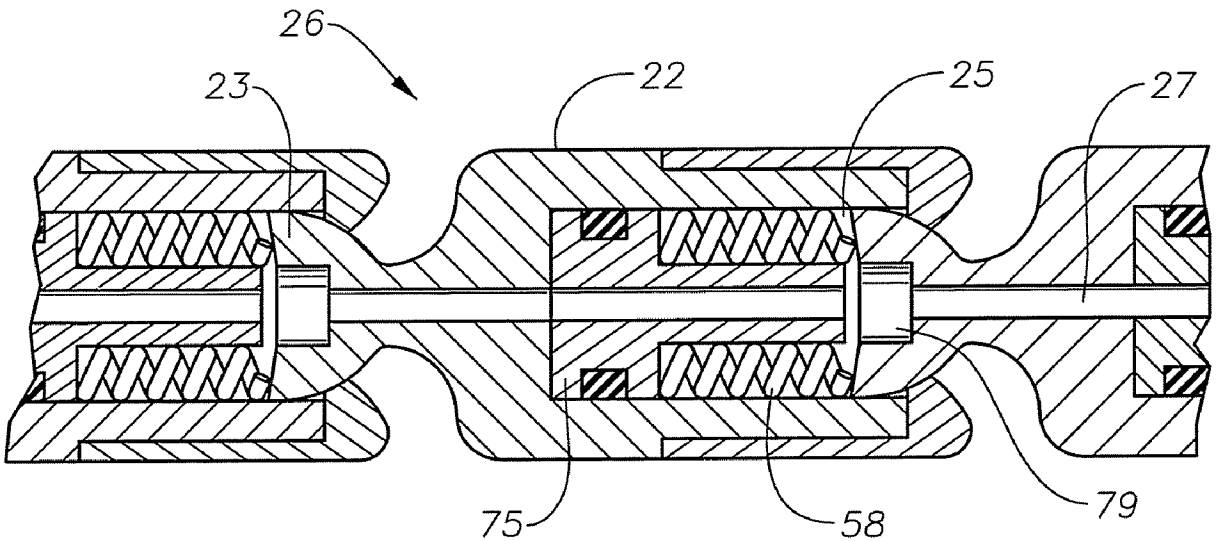
FIG. 6*a* provides a sectional view of a hose weight assembly for the roller assembly of FIG. 1.

In the embodiments illustrated in FIGS. 9 and 10, the flexible member 40 includes a weight assembly 26 on its lower end 41. An exit nozzle 21 is formed on the free end of the weight assembly 26. Weight assembly 26 details can be found in a side sectional view in FIG. 6*a*, where the weight assembly 26 is shown comprised of multiple rotatable push plug 22 elements. Each push plug element 22 comprises an inlet section 23 extending from the rearward end of each push plug element 22, and a locking socket 79 formed in the inlet section 23 free end. A cylinder 25 is formed in the forward end of the push plug element 22 housing a coaxially disposed piston 75. The inlet section 23 rotatingly and pivotingly fits within the cylinder 25 in the next adjacent element 22, thus each adjacent element 22 can rotate and pivot with respect to one another. A spring 58 within each cylinder 25 urges the head section 23 towards the forward end of the cylinder 25 and pushes the piston 75 towards the rearward end of the cylinder 25. An axial passage 27 extends axially through each head section 27 connecting the cylinders 25 of each adjacent rotatable push plug 22 and creates a fluid path through the entire weight assembly 26. The exit nozzle 21, which by virtue of the axial passage 27, is in fluid communication with the flexible member 40. The weight assembly 26 is stiffened by the springs 58, but it is bendable with a laterally applied force. Introducing pressurized fluid through the flexible member 40 to the weight assembly 26, with sufficient pressure, pushes the piston 75 rearward towards the inlet section 25 and the piston 75 aft end inserts into the locking socket 79. Inserting the piston 75 into the locking socket 79 prevents the push plug 22 from pivoting with respect to the inlet section 23, thereby further stiffening the weight assembly 26.

Figure 6B:
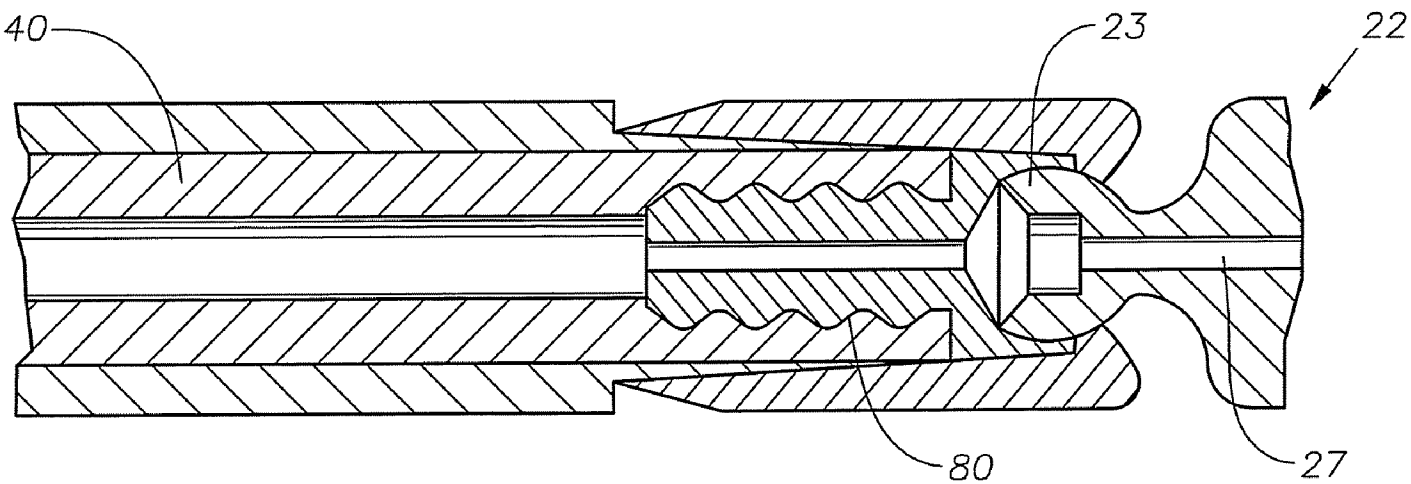
FIG. 6*b* provides a sectional view of a hose weight assembly for the roller assembly of FIG. 1.

Illustrated in FIG. 6*b*, is a coupling 80 for connecting the weight assembly 26 (FIG. 6*a*) to the flexible member 40. The coupling 80 body is clamped within the terminal end of the flexible member 40 and includes an opening that receives an inlet section 23 of a push plug 22 element. The opening is pivoting and rotatingly coupled to the inlet section 23, fluid in the flexible member 40 can flow through the coupling 80 annular body to the inlet section 23 and through the axial passage 27. The flexible member 40 can comprise a portion of a casing annulus remediation system for delivering fluids within a portion of a wellhead assembly 60 for remediation operations. Optionally, the flexible member 40 can comprise a wire or other elongated member suitable for insertion into a wellbore for other purposes. Other purposes may include inspection within the wellbore, where the inspection may be visual by the aid of an imbedded camera (not shown), or fiber optics extending along the length of the member 40. Additionally, inspection may be made by seismic or acoustic devices included with the flexible member 40.

Figure 3A:
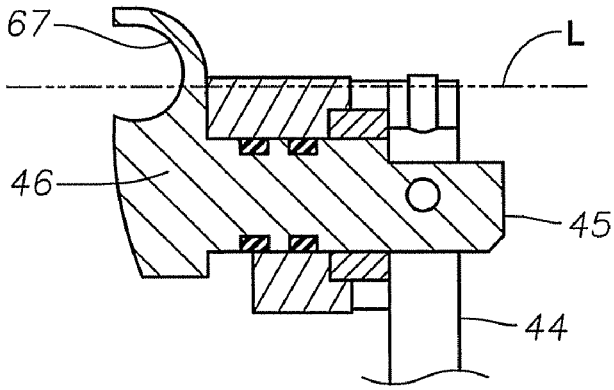
FIG. 3*a* is a side view illustration of a hand crank and a cam assembly for the roller assembly of FIG. 1.
Figure 3B:
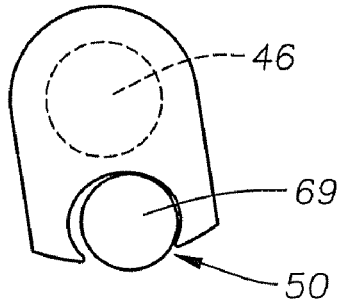
FIG. 3*b* is a sectional view of a coupling between the hand crank of FIG. 3*a* and the roller assembly of FIG. 1.
Figure 3C:
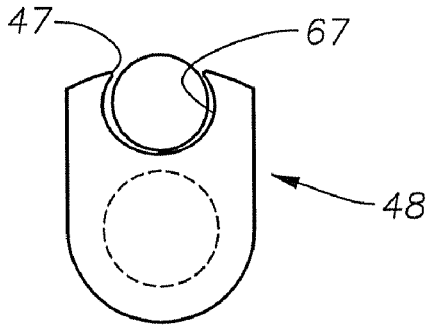
FIG. 3*c* is a sectional view of a coupling between the hand crank of FIG. 3*a* and the roller assembly of FIG. 1, the hand crank being rotated.

With reference now to FIG. 5, a bore 71 formed through the side of the pressure containment housing 10 receives the drive shaft 45 therethrough. Preferably, a seal 73 is included within the bore 71. The drive shaft 45 and female cam 46 are installed within the housing 10 prior to inserting the drive roller assembly 28. Referring now to FIGS. 3*b* and 3*c*, an embodiment of the female cam 46 includes an opening 47 formed through the free end of the female cam 46 to the socket 67. The opening 47 is formed to allow insertion of the ball 69 therein and into the socket 67. Forming the coupling 48 may include orienting the opening 47 and the ball 69 when installing the drive assembly 28 within the housing 10 so the ball 69 is aligned with the opening 47 thereby allowing the ball 69 to slide into the socket 67. FIG. 3*a* illustrates a side partial sectional view of the hand crank 44 attached to the drive shaft 45 with the female cam 46 laterally extending therefrom. Depicted in FIGS. 3*b* and 3*c*, viewed along line L from FIG. 3*a*, are examples of the coupling 48 between the female cam 48 and the male cam 50 in different rotational positions. The female cam 46 orbits about the drive shaft 45 axis as the drive shaft 45 rotates.

Figure 13:
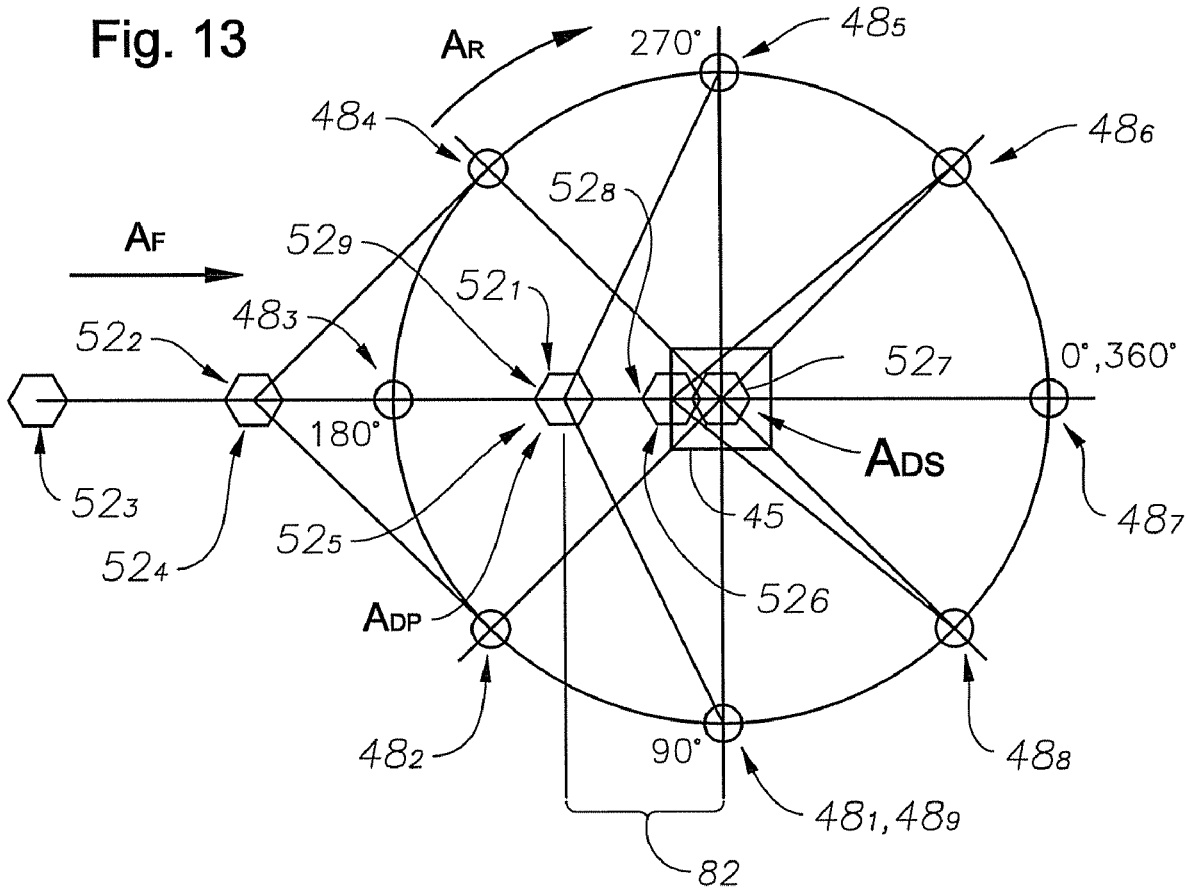
FIG. 13 is a diagram representing component positions over time of the drive roller assembly of FIG. 1.

As previously noted, the drive assembly 28 advances the flexible member 40 into the wellhead assembly 60 and combines the advancing motion with an intermittent reciprocating or pecking motion. The intermittent reciprocating or pecking motion is produced by the configuration of the male and female cam 50, 46 and by laterally offsetting the drive shaft axis $A_{DS}$ with the drive pin axis $A_{DP}$. FIG. 13 is a graphical representation representing coupling 48 and drive pin 52 movement with respect to the drive shaft 45. The drive shaft 45 is represented by a square in the origin of a circle, where the circle represents an orbital path the coupling 48 travels with drive shaft 45 rotation. Discrete coupling 48 positions are represented by smaller circles and drive pin 52 positions are represented by a hexagon. Numerical subscripts identify the respective location of each of these elements at a point in time. A curved arrow $A_R$ shows the coupling 48 rotational direction and an arrow $A_F$ represents the flexible member 40 advancement direction.

For the purposes of illustration herein, a Cartesian coordinate axis having an ordinate and abscissa is provided within the circle. Also for reference, radial notations about the circle are provided. For example, the 0° and 360° points along the circle are indicated where the abscissa intersects the circle when extending from the circle origin in the direction of arrow $A_F$. The 90° point is noted where the ordinate line extending from the origin downward intersects the circle, also provided are 180° and 270°. In the example of FIG. 13 the first position of the coupling 48 and drive pin 52 are represented respectively by the notation $\mathbf{48}_1$ at 90° on the circle and the notation $\mathbf{52}_1$. As noted above, the drive pin 52 is laterally offset from the drive shaft 45, which is represented by an offset value 82 along the abscissa aft of the drive shaft 45 (opposite the direction of the arrow $A_F$). The lines connecting $\mathbf{52}_{1\text{-}8}$ with $\mathbf{48}_{1\text{-}8}$ represent the body of the male cam 50, similarly the lines connecting $\mathbf{45}_{1\text{-}8}$ with $\mathbf{48}_{1\text{-}8}$ represent the body of the female cam 46.

It should be pointed out however, that the initial starting point of the coupling 48 and the drive pin 52 can be at other locations, including the drive pin 52 being forward of the drive shaft (i.e. the side of the drive shaft in the direction of the $A_F$ arrow) rather than on the aft side of the drive shaft. Drive shaft 45 rotation orbits the coupling 48 to a second location, depicted as $\mathbf{48}_2$, that slides the drive pin 52 further aft to a position represented by 522 at 180°. Continued drive shaft 45 rotation orbits the coupling to 270°, represented by 483, slides the drive pin 52 is at its fullest aft position at $\mathbf{53}_3$. Additional rotation of the drive shaft 45 rotates the coupling 48 past the 180° mark and correspondingly draws the drive pin 52 forward to the position 522 (which is the same as $\mathbf{53}_4$. The sequence of rotation in orbiting the coupling 48 and sliding the drive pin 52 forward continues until the coupling 48 orbits past the position denoted by $\mathbf{48}_7$ on its way to $\mathbf{48}_8$, in this region the drive pin 52 will experience a change in direction and be pushed aft, as represented by the displacement between $\mathbf{52}_7$ and $\mathbf{52}_8$. Accordingly, the drive pin 52 and the drive assembly 28 are pushed into a forward position as the coupling 48 passes from the 180° mark to the 0 or 360° mark and the drive pin 52 and assembly 28 is slid in an aft direction between 0° and 180°. During this time however, the rollers will continue to rotate and feed the flexible member 40 (FIG. 1) in the direction of the arrow $A_F$ and into the wellhead assembly 60.

The combination of the continuous hose 40 advancement from the rollers and the reciprocating action on the drive assembly 28 causes an intermittent reciprocating or pecking motion on the hose end 41. This motion enables the member end 41 to avoid obstacles within the wellhead assembly 60. The linkages illustrated in FIG. 13 are provided to represent an example of sliding reciprocating motion of the drive pin and drive roller assembly 28 and are not to be limited to the mechanical connection means between the drive shaft 45 and the drive assembly 28. Other configurations are available where the reciprocating motion of the drive pin 52 (i.e. movement in the aft position) occurs at a fraction of the arc link illustrated in FIG. 13. For example, configurations are possible wherein the drive pin is slid in an aft position only when the coupling is orbiting from around the 180° position to about the 270° position, or any other range of degrees along the circle illustrated. Moreover, a reciprocating action can be developed to occur at other than once every revolution of the drive shaft 45, i.e. more than once per revolution, or one reciprocating action for every multiple revolutions.

Figure 12:
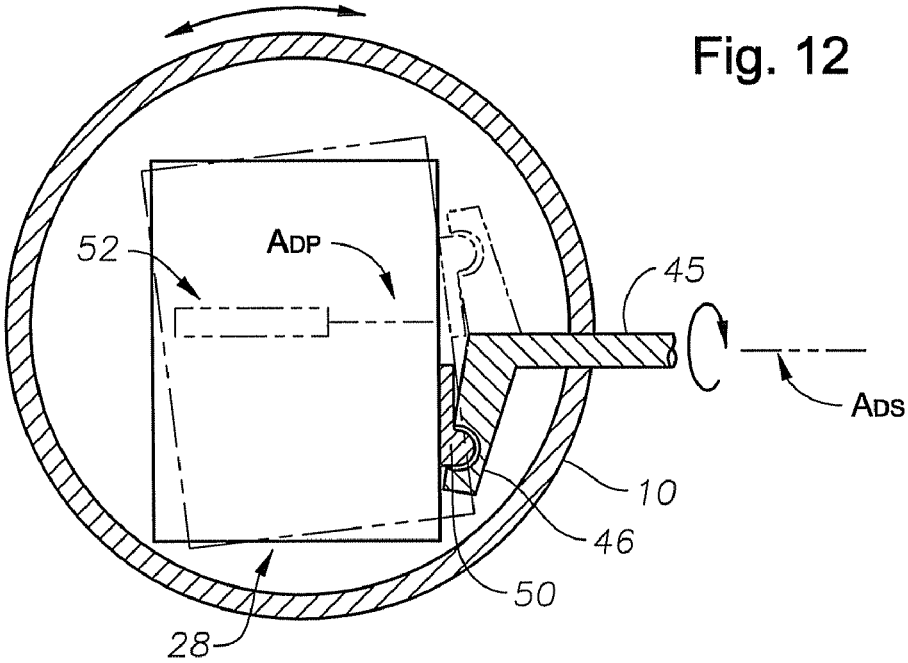
FIG. 12 is a schematic end view representing the drive roller assembly of FIG. 1 in a rocking motion.

The drive assembly 28 of FIG. 5 may also impart a back and forth rolling motion to the flexible member 40 due to the angle between the female cam 46 and the drive shaft axis $A_{DS}$. Creating a rolling motion in the flexible member 40 is portrayed in a schematic view in FIG. 12. The rolling motion is illustrated by representing the female cam 46 and drive roller assembly 28 positions before and after rotating the drive shaft 45 approximately 180 degrees. The drive roller assembly 28 and female cam 46 after rotation are shown in a dashed outline. Although exaggerated for clarity, the female cam 46 is at an oblique angle with respect to the drive shaft axis $A_{DS}$. The oblique angling combined with the rotating male cam 50 results in a pushing action that alternates on the lower and upper lateral sides of the drive roller assembly 28. Optionally, the male cam 50 could be obliquely angled from the drive pin or drive shaft axes ($A_{DP}$, $A_{DS}$), or both cams could be obliquely angled. The alternating pushing action on different portions of the drive roller assembly imparts the resulting rocking action onto the assembly 28 with each drive shaft 45 rotation to pivot the drive roller assembly 28 about its longitudinal axis. This in turn rotates the flexible member 40 due to the coupling between the flexible member 40 and the rollers of the drive roller assembly 28. Also represented by a dashed outline, is the orientation of the drive pin 52 and its corresponding axis $A_{DP}$. Although the drive pin axis $A_{DP}$ appears aligned with the drive shaft axis $A_{DS}$ these axes are offset laterally by some distance, but may have the same elevation.

Figure 11:
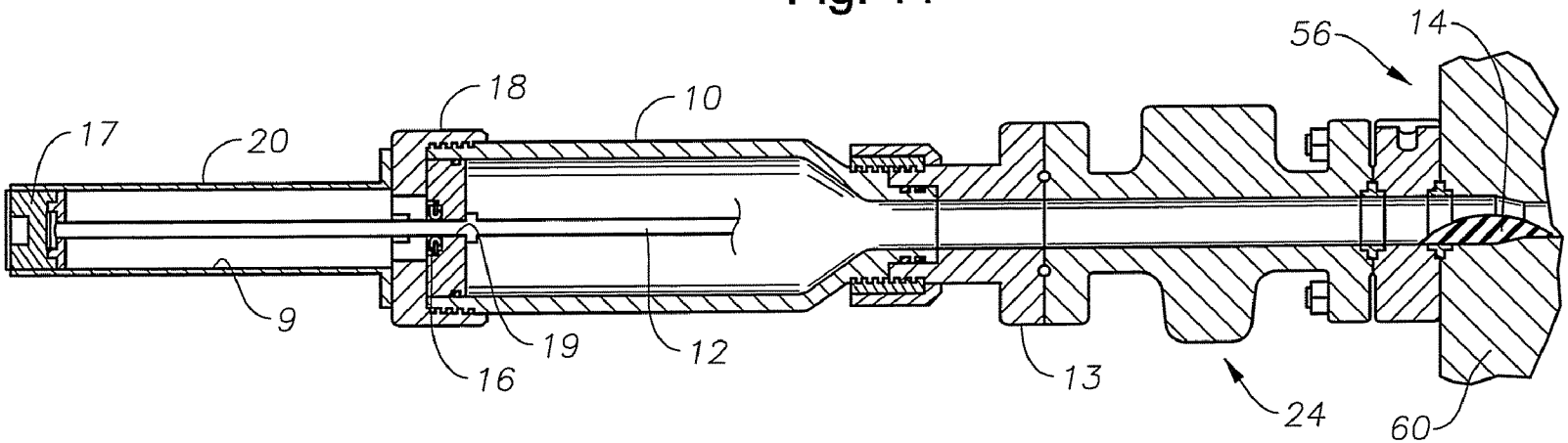
FIG. 11 is a side partial sectional view of an insert installation assembly within a pressure housing.

Inserting the polymeric insert 14 may be accomplished with the assembly illustrated in a partial sectional view of FIG. 11. Here an installation rod 12 is disposed through the pressure containment housing 10, without the drive roller assembly 28 in the housing 10. The insert 14 having a passage axially formed therethrough is attached on the terminal end of the installation rod 12. The forward end of the housing 10 is threadingly attached to a flange 13 and the aft end of the housing includes an end cap 18 threadingly attached thereon. The end cap 18 includes a bore 19 formed there through to receive the installation rod 12, with seals 16 on the inner surface of the end cap 18 surrounding the bore 19. A push rod housing 20 having a rotatable spindle 17 is shown attached to the end cap 18 outer side. Threads formed on the spindle 17 outer surface engage threads 9 formed along the push rod housing 20 inner circumference. Rotating the spindle 17 motivates it and the installation rod 12 forward within the housing 20 thereby pushing the insert 14 into the wellhead axis port 56.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

What is claimed is:

1. A system for inserting a flexible member into a wellhead assembly, the system comprising:

a drive assembly having a drive roller for frictionally engaging and advancing the flexible member into the wellhead assembly, wherein the drive assembly and drive roller are laterally moveable is a direction generally parallel to the flexible member;

a rotatable drive shaft having an axis offset from an axis of the drive roller; and a coupling member for connecting the drive shaft to the drive roller, the coupling member rotating the drive roller about its axis in response to drive shaft rotation and because of the offset between the axis of the drive shaft and the drive roller, the coupling member laterally reciprocating the drive assembly in forward and rearward directions about the drive shaft.

2. The system of claim 1 wherein the coupling member comprises a first linking arm affixed on one end to the drive shaft and rotatingly coupled on its other end to a portion of a second linking arm, the linking arm affixed on another portion to a drive pin, the drive pin coaxially affixed within the drive roller.

3. The system of claim 2, wherein the first linking arm is coupled to the second linking arm with a ball and socket type arrangement, the socket having an opening for receiving the ball therein.

4. The system of claim 2, wherein one of the first or second linking arms is aligned oblique to the drive shaft axis thereby pivoting the drive assembly about its longitudinal axis in one direction and pivoting the drive assembly about its longitudinal axis in a generally opposite direction when rotating the drive shaft 180°.

5. A system for feeding a flexible member into a passage of a wellhead assembly, the system comprising:

a drive roller assembly comprising a drive roller frictionally engageable with the flexible member and a member exit affixed to the wellhead passage;

a first cam member having one end mechanically connected to the roller, the first cam member oriented generally perpendicular to the roller axis;

a second cam member coupled to the first cam member with a coupling, wherein the coupling is offset from the drive roller axis; and a drive shaft affixed to the second cam member, the drive shaft axis oriented substantially parallel to the drive roller axis and offset from the drive roller axis, wherein the drive roller rotates and intermittently laterally reciprocates in response to drive shaft rotation thereby advancing the flexible member through the drive assembly and intermittently retracting the flexible member.

6. The system of claim 5, wherein the mechanical connection between the first cam member and the drive roller comprises a drive pin coaxially extending through the drive roller, affixed on one end to the first cam, and connected to the drive roller on its outer surface.

7. The system of claim 5 wherein the second cam member is disposed generally perpendicular to the drive roller axis.

8. The system of claim 5 wherein the second cam member is disposed oblique to the drive roller axis.

9. The system of claim 8, wherein the obliquely oriented second cam member pivots the drive assembly about its longitudinal axis, and wherein rotating the drive shaft and second cam member reciprocatingly rolls the drive assembly about its longitudinal axis thereby rotating the flexible member in reciprocal motion about is longitudinal axis.

10. The system of claim 5, wherein the coupling and the drive shaft axis are offset.

11. The system of claim 5, further comprising a sprocket coaxially affixed to an outer circumference of the drive pin outer circumference.

12. The system of claim 11, wherein the flexible member is compressed between opposing surfaces of two rollers.

13. The system of claim 5, wherein the drive assembly further comprises a drive pin coaxially inserted within the drive roller and a drive sprocket coaxially affixed onto an end of the drive pin.

14. A method of inserting a flexible member into a port of a wellhead assembly, the method comprising:

coupling the flexible member to a drive roller assembly having a plurality of drive rollers;

rotating the drive rollers thereby advancing the flexible member into the wellhead assembly; and reciprocating the drive rollers in forward and rearward direction thereby intermittently imparting a pecking motion onto the end of the flexible member within the wellhead assembly.

15. The method of claim 14 further comprising rocking the drive rollers from side to side thereby rotating the flexible member in reciprocating motion.

* * * * *